US005110511A

United States Patent [19]

Hand

[11] Patent Number: 5,110,511

[45] Date of Patent: May 5, 1992

[54] HUMIDIFIER

[75] Inventor: Joseph M. Hand, Sheboygan Falls, Wis.

[73] Assignee: Bemis Manufacturing Company, Sheboygan Falls, Wis.

[21] Appl. No.: 764,944

[22] Filed: Sep. 24, 1991

Related U.S. Application Data

[63] Continuation of Ser. No. 644,939, Jan. 23, 1991, abandoned, which is a continuation-in-part of Ser. No. 546,584, Jun. 29, 1990, abandoned.

[51] Int. Cl.[5] ..... B01F 3/04

[52] U.S. Cl. ..... 261/104; 261/DIG. 41; 261/DIG. 46; 55/497

[58] Field of Search ..... 261/104, DIG. 41, DIG. 46, 261/107; 55/497

[56] References Cited

U.S. PATENT DOCUMENTS

| | | | |
|---|---|---|---|
| 872,330 | 12/1907 | Cunningham | 261/104 |
| 1,625,663 | 4/1927 | Kelly | 261/104 |
| 1,727,658 | 9/1929 | Matteson | 261/104 |
| 1,883,778 | 10/1932 | Freeman | 261/104 |
| 2,054,200 | 9/1936 | Langford | 261/107 |
| 2,749,725 | 6/1956 | Essman et al. | 261/104 |
| 2,856,166 | 10/1958 | Goettl | 261/29 |
| 2,934,022 | 4/1960 | Rodick et al. | 261/29 |
| 3,045,450 | 7/1962 | Chandler | 261/104 |
| 3,191,915 | 6/1965 | Goettl | 261/97 |
| 3,307,835 | 3/1967 | Perlman | 261/27 |
| 3,479,018 | 11/1969 | Jaye | 261/103 |
| 3,659,719 | 5/1972 | Westlin et al. | 210/483 |
| 3,864,437 | 2/1975 | Blaszkowski | 261/24 |
| 4,063,895 | 12/1977 | Neti et al. | 23/232 R |
| 4,118,193 | 10/1978 | Neti et al. | 422/94 |
| 4,259,269 | 3/1981 | Flowers | 261/151 |
| 4,272,248 | 6/1981 | Neti | 23/232 R |
| 4,302,422 | 11/1981 | Takahaski | 422/88 |
| 4,323,193 | 4/1982 | Compton et al. | 239/44 |
| 4,333,887 | 6/1982 | Goettl | 261/27 |
| 4,382,433 | 5/1983 | Hess et al. | 126/113 |
| 4,499,030 | 2/1985 | Stewart | 261/28 |
| 4,561,981 | 12/1985 | Characklis | 210/696 |
| 4,685,944 | 8/1987 | Allan et al. | 55/491 |
| 4,822,533 | 4/1989 | Steiner et al. | 261/72.1 |
| 4,865,775 | 12/1989 | Steiner et al. | 261/24 |

FOREIGN PATENT DOCUMENTS

| | | |
|---|---|---|
| 1776236 | 10/1974 | Fed. Rep. of Germany . |
| 2604169 | 8/1977 | Fed. Rep. of Germany . |
| 3312658 | 8/1985 | Fed. Rep. of Germany . |
| 781194 | 8/1957 | United Kingdom . |

*Primary Examiner*—Tim Miles
*Attorney, Agent, or Firm*—Michael, Best & Friedrich

[57] ABSTRACT

A humidifier comprising a trough adapted to contain water, a wicking assembly having a lower end located in the trough and including a plurality of wick portions each including a generally planar strip of wicking material having an end, and a pleated strip of wicking material secured to the planar strip, and a frame for supporting the wick portions in generally parallel, side-by-side relation, the frame including a first frame member extending generally perpendicular to the planar strips and adjacent the ends of the planar strips and having therethrough a slot elongated in a direction generally perpendicular to the planar strips, and an adhesive extending into the slot and adhering to the ends of the planar strips for securing the ends of the planar strips to the frame member, and a fan for causing air flow through the wicking assembly.

25 Claims, 4 Drawing Sheets

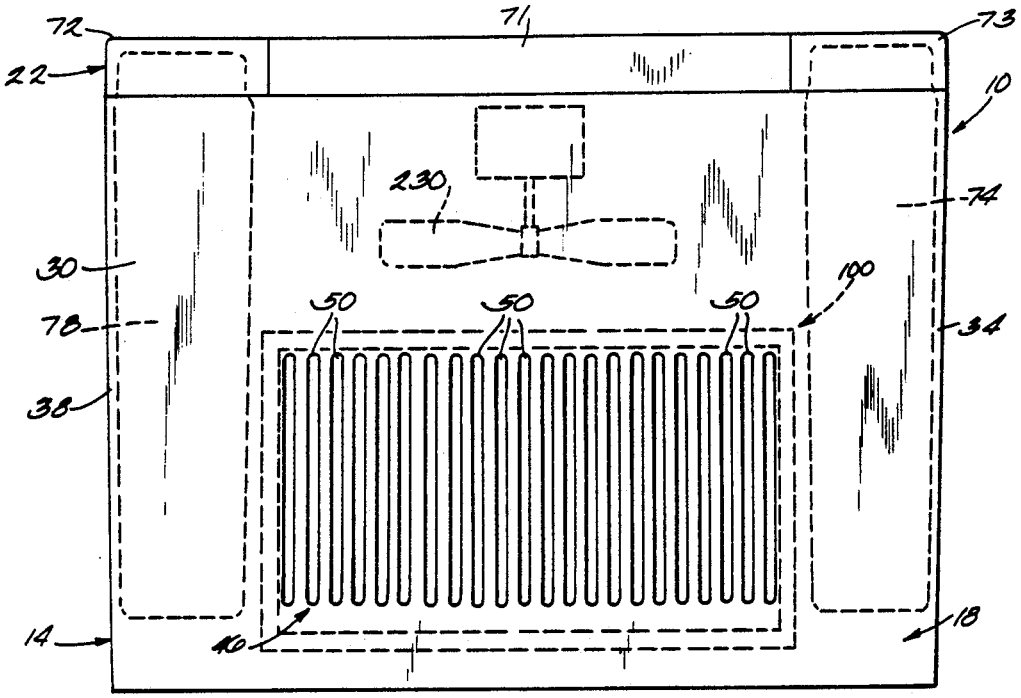
Fig. 1
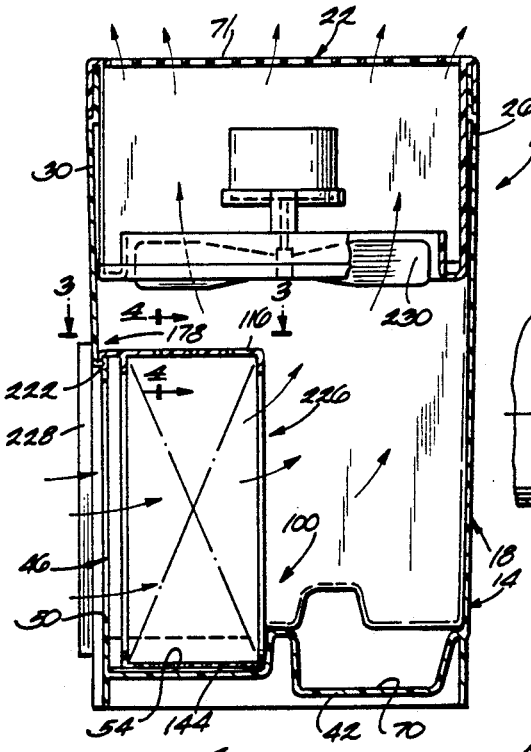
Fig. 2
Fig. 3
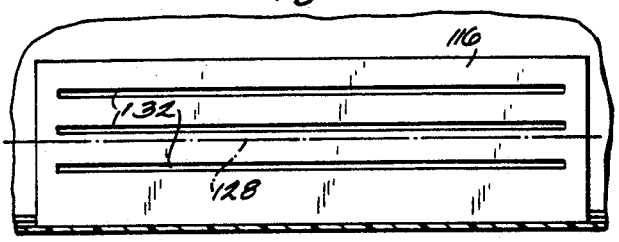
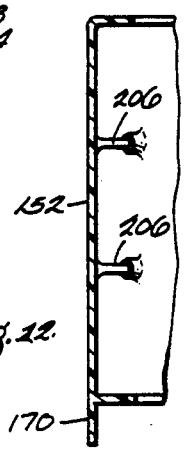
Fig. 12
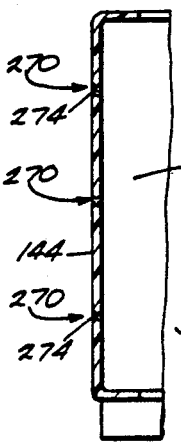
Fig. 14

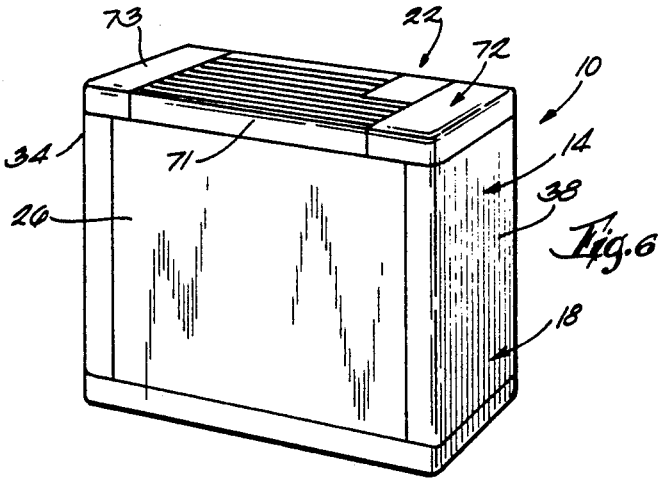
Fig. 6
Fig. 7
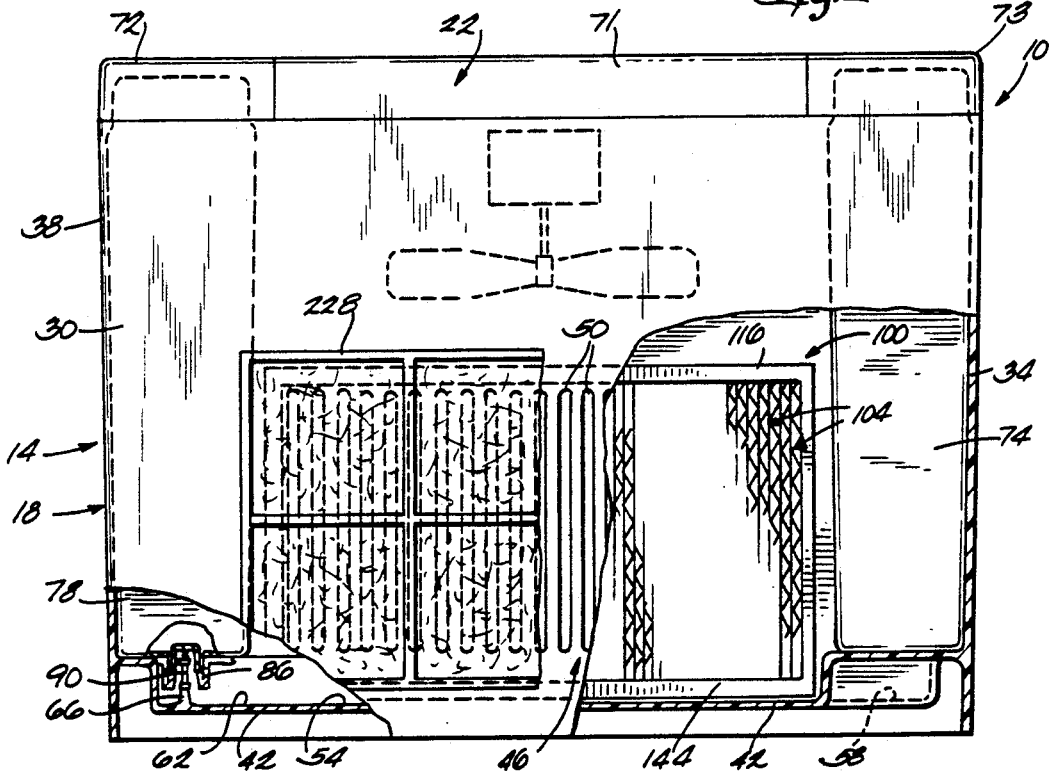
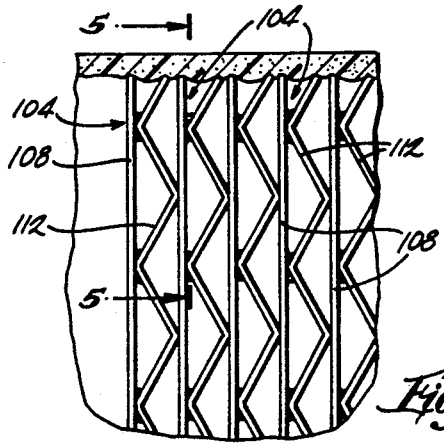
Fig. 4
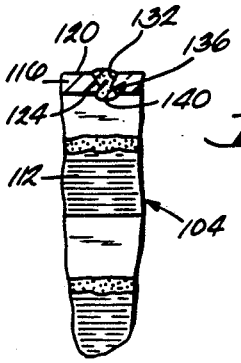
Fig. 5

300
312
116
304
128
108

120
140
312
124
108

116
140
308
120
124
108

308
17
312
19
18
304
140

112
108
312
140
120
124

HUMIDIFIER

RELATED APPLICATION

This is a continuation of application Ser. No. 644,939, filed Jan. 23, 1991, now abandoned, which is a continuation-in-part of application Ser. No. 546,584, filed Jun. 29, 1990, now abandoned.

BACKGROUND OF THE INVENTION

The invention relates to humidifiers, and more particularly to evaporative home humidifiers.

A conventional home humidifier includes a reservoir or tank of water through which is passed an endless belt fabricated of an air permeable medium such as reticulated polyurethane foam. Air blown through the portion of the belt that is not in the water evaporates water from the belt and transfers the water to the atmosphere as a vapor.

Another known humidifier includes a reservoir or tank of water and a wicking element that is supported in the water on floats so that only the lower end of the wicking element is immersed in the water. The wicking element moves downwardly relative to the reservoir as the water level falls. Air blown through the wicking element evaporates water from the wicking element and transfers the water to the atmosphere. An example of this type of humidifier is disclosed in U.S. Pat. No. 4,822,533, issued Apr. 18, 1989.

Attention is directed to U.S. Pat. Ser. No. 512,889, now U.S. Pat. No. 5,037,583, which was filed Apr. 23, 1990, which is assigned to the assignee hereof, and which is incorporated herein by reference.

SUMMARY OF THE INVENTION

The invention provides a humidifier utilizing a stationary wicking assembly rather than a floating or moving wicking assembly. The lower end of the wicking assembly is located in a water trough in which a relatively constant level of water is maintained. The wicking assembly includes a plurality of wick portions each including a flat strip of wicking material or paper and a pleated strip of wicking material or paper secured to the flat strip. This construction is known in the art. The wicking assembly also includes a frame supporting the wick portions in parallel, side-by-side relation.

The frame preferably includes upper and lower horizontally extending members and left and right vertically extending members extending between and connecting the upper and lower members. The flat strips of wicking material preferably extend vertically so that the opposite ends of the flat strips abut the upper and lower frame members.

The upper frame member has therethrough a plurality of generally parallel, elongated slots extending substantially the entire length of the frame member. In one embodiment of the invention, each of the slots includes a portion that is downwardly converging or tapered, and each slot is filled with a water-resistant adhesive or hot melt that adheres to the upper ends of the flat strips of wicking material and that, by adhesion and by virtue of a wedging action in the converging portion of the slot, secures the upper ends of the flat strips to the upper frame member. In an alternative embodiment of the invention, the slots have generally parallel walls and a plurality of ribs extend across and beneath the slots. Each slot is filled with a water-resistant adhesive or hot melt that surrounds the ribs. As the adhesive hardens, it mechanically interlocks with the ribs and adheres to the ends of the strips. If desired, the lower frame member can be provided with similar adhesive-filled slots.

The humidifier also comprises a cabinet housing the wicking assembly and having therein an air inlet, and the frame preferably forms a conduit or duct or plenum that substantially sealingly communicates with the air inlet so that substantially all of the air entering the cabinet through the air inlet passes through the wicking assembly. This insures that substantially all of the air passing through the humidifier is humidified. The air inlet is preferably located in the rear wall of the cabinet, and the frame abuts the inner surface of the rear wall in communication with the air inlet. A fan housed within the cabinet draws air into the cabinet through the air inlet and through the wicking assembly.

In the preferred embodiment of the invention, the cabinet is made of injection-molded plastic, and the trough is an integral part of the bottom wall of the cabinet. Since the wicking assembly frame abuts the rear wall of the cabinet, the trough is located adjacent the rear wall. The bottom wall of the cabinet preferably also defines, in addition to the trough, an overflow reservoir that is located forwardly of the trough and that receives any water accidentally overflowing the trough. This would happen, for example, if the cabinet were accidentally tipped forwardly.

In one embodiment of the invention, the lower frame member includes one or more pockets which are located in the trough and which contain a timed-release biocide. The biocide preferably lasts for an entire humidifying season.

Other features and advantages of the invention will become apparent to those skilled in the art upon review of the following detailed description, claims and drawings.

DESCRIPTION OF THE DRAWINGS

FIG. 1 is a rear elevational view of a humidifier embodying the invention.

FIG. 2 is a vertical sectional view of the humidifier.

FIG. 3 is a view taken along line 3—3 in FIG. 2.

FIG. 4 is a view taken along line 4—4 in FIG. 2.

FIG. 5 is a view taken along line 5—5 in FIG. 4.

FIG. 6 is a front perspective view of the humidifier.

FIG. 7 is a rear elevational view, partially in section, of the humidifier.

FIG. 12 is a view taken along line 12—12 in FIG. 8.

FIG. 14 is a view taken along line 14—14 in FIG. 8 and showing the wicking assembly of another alternative embodiment of the invention.

FIG. 18 is a view taken along line 18—18 in FIG. 16.

Figure 8:
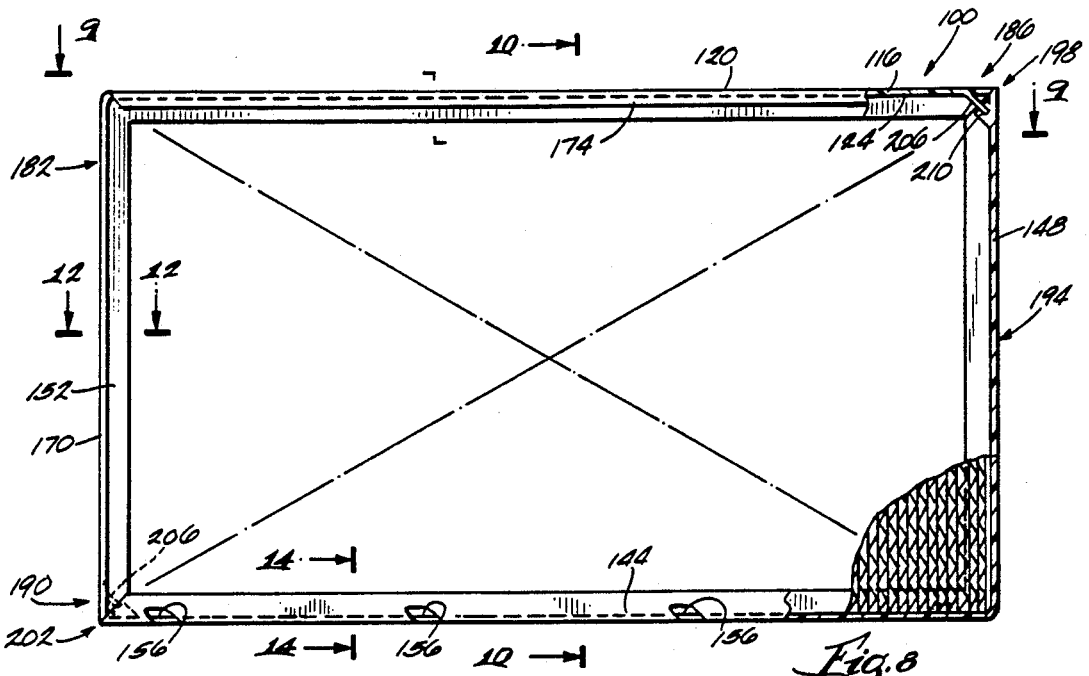
FIG. 8 is a rear elevational view, partially in section, of the wicking assembly of the humidifier.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A humidifier 10 embodying the invention is illustrated in FIGS. 1–12. Except as described hereinafter, the humidifier 10 is substantially identical to the humidifier described in the above-mentioned U.S. Pat. Ser. No. 512,889, filed Apr. 23, 1990.

The humidifier 10 comprises (see FIGS. 1 and 2) a cabinet 14 including a base 18 and a cover 22. The base 18 is preferably unitary and injection-molded and includes opposite front and rear walls 26 and 30, opposite left and right side walls 34 and 38, and a bottom wall 42 extending between the side walls 34 and 38 and between the front and rear walls 26 and 30. The rear wall 30 has therein an air inlet 46 which, in the illustrated construction, is formed by a plurality of vertically extending slots 50 in the rear wall 30. The rear wall 30 and the bottom wall 42 define (see FIGS. 2, 7 and 10) a trough 54 located beneath the air inlet 46 and adapted to contain water. The bottom wall 42 also defines (see FIG. 7) left and right channels 58 and 62 extending laterally from and communicating with the trough 54. Each of the channels 58 and 62 has therein an upwardly extending pin or projection 66. The bottom wall 42 also defines (see FIG. 2) an overflow reservoir 70 which is located forwardly of the trough 54 and which provides reservoir means for receiving water accidentally overflowing the trough 54.

The cover 22 preferably includes (see FIG. 6) a central portion 71 which supports the below-described fan and the controls (not shown) for the humidifier 10, and right and left outer portions 72 and 73 which cover and afford access to the below-described water bottles.

The humidifier 10 also comprises (see FIGS. 1 and 7) container means adapted to contain water. While various suitable container means can be employed, in the illustrated construction, the container means includes substantially identical left and right water bottles or containers 74 and 78 housed within the cabinet 14 on opposite sides of the trough 54. Suitable containers are described in the above-mentioned U.S. Pat. Ser. No. 512,889, filed Apr. 23, 1990. Each container 74 or 78 has an outlet on its lower end.

The humidifier 10 also comprises (see FIG. 7) means for supplying water from the containers 74 and 78 to the trough 54. While various suitable supplying means can be employed, in the preferred embodiment, such means includes a cap/valve apparatus 86 removably threaded onto the outlet of each of the water bottles 74 and 78. Such a cap/valve apparatus is described in the above-mentioned application Ser. No. 512,889, filed Apr. 23, 1990. When a water bottle 74 or 78 is placed in the cabinet 14, the cap/valve apparatus 86 extends into the associated channel 58 or 62 and the pin 66 engages a plunger 90 on the cap/valve apparatus 86 to allow water flow out of the bottle 74 or 78. Water flows out of the bottle 74 or 78 until the level of water in the trough 54 and in the channels 58 and 62 rises to the level of the bottle outlet. Thereafter, water does not flow out of the bottle until the level of water in the trough 54 falls below the bottle outlet.

The humidifier 10 also comprises (see FIGS. 7–11) a wicking assembly 100 adapted to absorb water from the trough 54. The wicking assembly 100 includes a plurality of wick portions 104. Each wick portion 104 preferably includes (see FIGS. 4 and 5) a generally planar strip 108 of wicking material having upper and lower ends, and a pleated strip 112 of wicking material secured to the planar strip 108. Such wick portions 104 are known in the art. The wicking assembly 100 also includes frame means for supporting the wick portions 104 in generally parallel, side-by-side relation. In the illustrated construction, the wick portions 104 extend generally vertically, and the frame means includes (see FIGS. 7–11) a first or upper frame member 116 extending generally horizontally (and thus perpendicular to the planar strips 108) and extending adjacent the upper ends of the planar strips 108. The upper frame member 116 has an outer or upper surface 120, and an inner or lower surface 124 adjacent the upper ends of the planar strips 108. The upper frame member 116 also has a longitudinal axis 128 (FIG. 3) and has therethrough a plurality of slots 132 extending generally parallel to the axis 128 and thus being elongated in a direction generally perpendicular to the planar strips 108. In the illustrated construction, as shown in FIG. 5, each slot 132 extends between the inner and outer surfaces 120 and 124 of the upper frame member 116 and includes a downwardly converging or tapered or restricted, portion 136 having a cross-sectional area decreasing in the direction from the outer surface 120 to the inner surface 124, i.e., downwardly.

The frame means also includes adhesive means secured to the ends of the planar strips 108 and mechanically interlocked with the upper frame member 116. In the embodiment of the invention illustrated in FIGS. 1–12, the adhesive means extends into and fills each of the slots 132 and adheres to the upper ends of the planar strips 108 for securing the upper ends of the planar strips 108 to the upper frame member 116. The adhesive means is preferably a water-resistant adhesive or hot melt 140 that may adhere to the upper frame member 116 but that, in any event, hardens and interlocks with the converging portion 136 of each of the slots 132 so that the adhesive 140 is substantially prevented from coming out of the slots 132. The adhesive thus becomes a rigid structure or material that is located on the opposite side of the restricted portion 136 from the wick portions 104 and that is prevented from coming out of the slot 132 by a wedging action in the restricted portion 136 of the slot 132. Because the adhesive 140 adheres to the upper ends of the planar strips 108, the adhesive 140 thus secures the upper ends of the planar strips 108 to the upper frame member 116.

Figure 10:
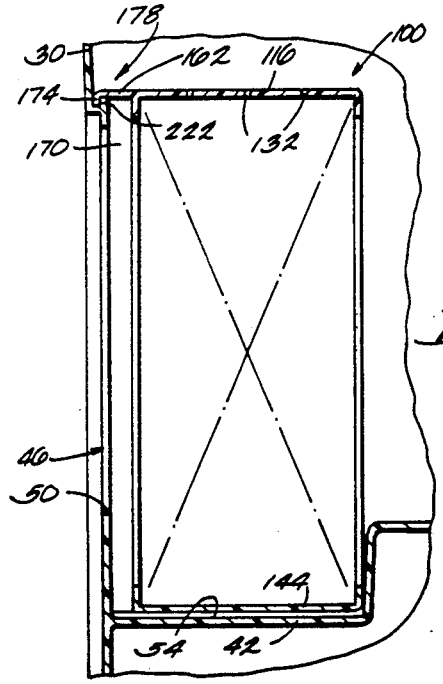
FIG. 10 is a view taken along line 10—10 in FIG. 8 and also showing a portion of the humidifier cabinet.
Figure 11:
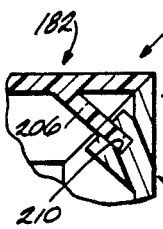
FIG. 11 is an enlarged portion of FIG. 8.
Figure 9:
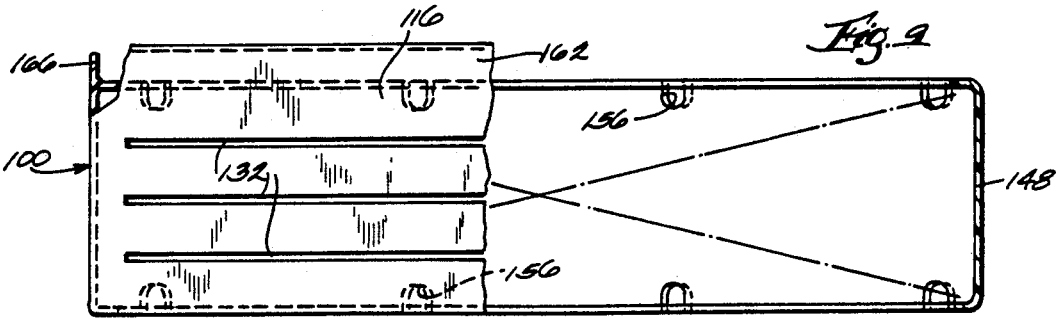
FIG. 9 is a view taken along line 9—9 in FIG. 8.
Figures 15, 16, 17, 19:
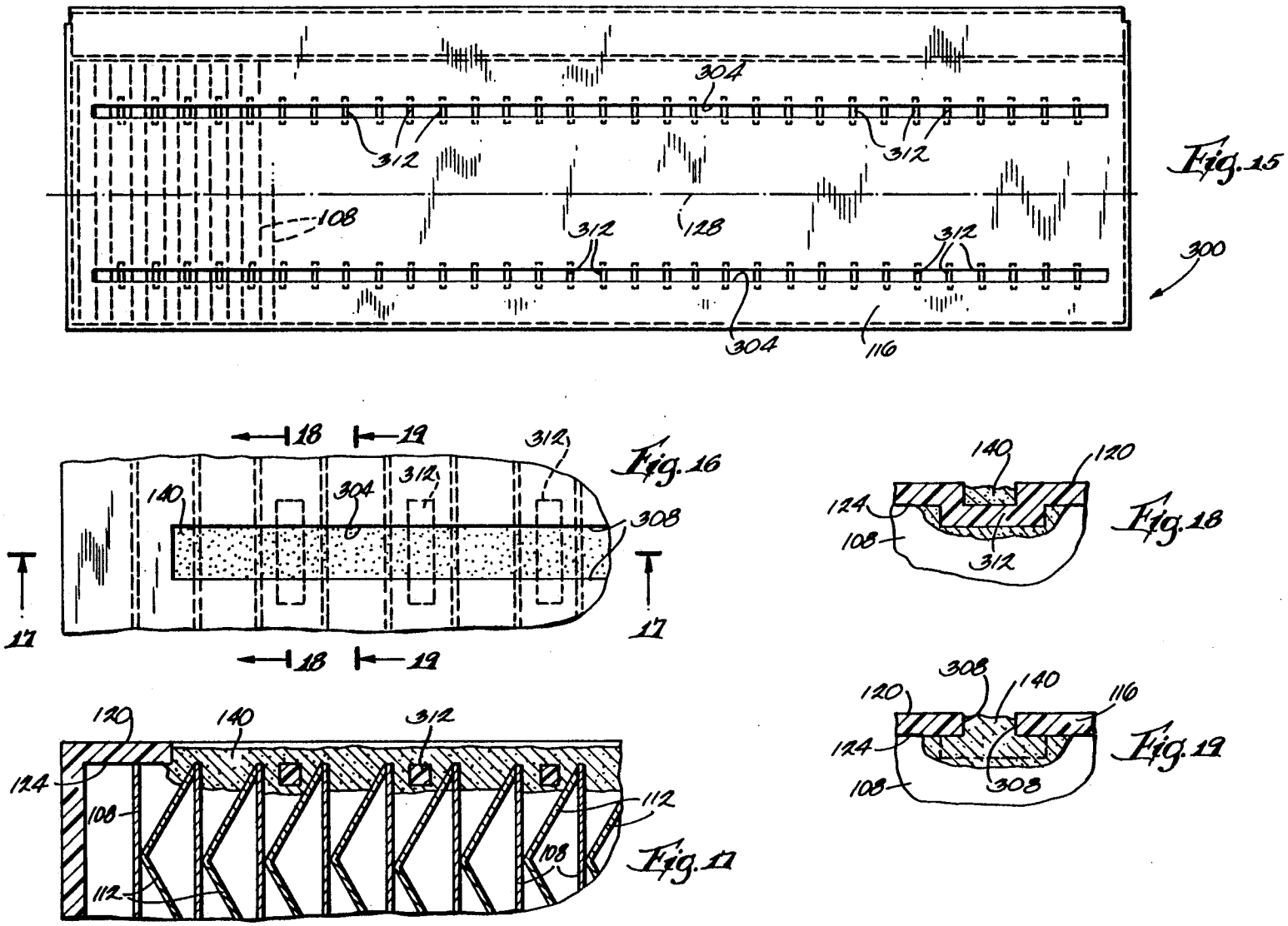
FIG. 15 is a top plan view of the wicking assembly of another alternative embodiment of the invention.
FIG. 16 is an enlarged portion of FIG. 15.
FIG. 17 is a view taken along line 17—17 in FIG. 16.
FIG. 19 is a view taken along line 19—19 in FIG. 16.

The frame means preferably also includes (see FIGS. 7–11) a second or lower frame member 144 extending generally horizontally and adjacent the lower ends of the planar strips 108, a generally vertically extending third or left frame member 148 extending between the left ends of the upper and lower frame members 116 and 144, and a generally vertically extending fourth or right frame member 152 extending between the right ends of the upper and lower frame members 116 and 144. As shown in FIGS. 9, 10 and 12, each of the frame members 116, 144, 148 and 152 has a channel-shaped cross section with inner dimensions substantially equal to the outer dimensions of one of the planar strips 108, so that the ends of the planar strips 108 fit snugly inside the frame members 116, 144, 148 and 152. Furthermore, the lower frame member 144 preferably has therein a plurality of apertures 156, the reason for which is explained hereinafter.

The upper frame member 116 and the left and right frame members 148 and 152 have thereon (see FIGS. 8–10) respective rearwardly extending flange or wall portions 162, 166 and 170. Furthermore, the rearwardly extending flange 162 of the upper frame member 116 includes (see FIG. 10), on its rearward end, a downwardly extending lip 174 which, in combination with the rearwardly extending flange 162, defines a hook-shaped member 178. The reasons for the flanges 162, 166 and 170 and the hook-shaped member 178 are explained hereinafter.

In the illustrated construction (see FIG. 8), the left and upper frame members 148 and 116 are integrally connected to form an L-shaped frame section 182 having an upper right end 186 and a lower left end 190, and the right and lower frame members 152 and 144 are integrally connected to form an L-shaped frame section 194 having an upper right end 198 and a lower left end 202. While the frame sections 182 and 194 can be connected by any suitable means, in the illustrated construction (see FIG. 11), the frame section 182 has projections 206 on its upper right end 186 and the frame section 194 has, in its upper right end 198, recesses 210 receiving the projections 206. A similar arrangement secures the lower left end of the section 182 to the lower left end of the section 194. A suitable adhesive (not shown) further secures the frame sections 182 and 194 to each other.

The humidifier 10 also comprises (see FIG. 10) means for supporting the wicking assembly 100 within the cabinet 14 so that the lower end of the wicking assembly 100 is located in the trough 54, and so that the upper frame member 116 extends above the air inlet 46 and the left and right frame members 148 and 152 extend on opposite sides of the air inlet 46. While various suitable supporting means can be employed, in the illustrated construction, the rear wall 30 of the cabinet 14 includes, above the air inlet 46, an upwardly extending lip 222 interengaged with the hook-shaped member 178 on the upper frame member 116 so that the wicking assembly 100 hangs from the rear wall 30 of the cabinet 14. Thus, the flange 162 on the upper frame member 116 engages the rear wall 30 of the cabinet 14 in a substantially airtight manner. As shown in FIG. 10, the rearwardly extending flanges 166 and 170 on the left and right frame members 148 and 152 also engage the rear wall 30 of the cabinet 14 in a substantially airtight manner, although the flange members 166 and 170 may be slightly spaced from the rear wall 30 of the cabinet 14 adjacent the upper end of the wicking assembly 100. The openings 156 in the lower frame member 144 permit water flow through the lower frame member 144.

Thus, the frame members 116, 144, 148 and 152 define a conduit 226 substantially sealingly communicating with the air inlet 46 and housing the wick portions 104 such that substantially all of the air entering the cabinet 14 through the air inlet 46 passes through the conduit 226 and over the wick portions 104.

The humidifier 10 preferably also comprises (see FIGS. 2 and 7) a filter 228 removably secured to the outside of the rear wall 30 of the cabinet 14 in registry with the air inlet 46.

The humidifier 10 also comprises (see FIG. 2) means for causing air flow through the wicking assembly 100. While various suitable means can be used, in the illustrated construction, such means includes a fan 230 supported within the cabinet 14. As shown in FIG. 2, the fan 230 draws air into the cabinet 14 through the filter 228, the air inlet 46 and the conduit 226 formed by the wicking assembly 100 and then upwardly and out through the cover 22.

Figure 13:
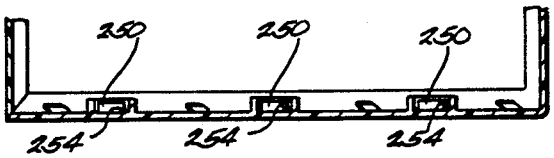
FIG. 13 is a partial sectional view of an alternative embodiment of the invention.

An alternative embodiment of the invention is illustrated in FIG. 13. In the alternative embodiment, the lower frame member 144 includes means for housing a biocide 250. Such means preferably includes a plurality of recesses or pockets 254 defined on the upper side of the lower frame member 144. The biocide 250 is preferably a timed-release biocide that lasts for an entire humidifying season.

A second alternative embodiment of the invention is illustrated in FIG. 14. In the second alternative embodiment, the lower frame member 144 has therein a plurality of slots 270 substantially identical to the slots 132 in the upper frame member 116, and the wicking assembly 100 further includes adhesive means 274 which extends into and fills the slots 270 in the lower frame member 144 and which adheres to the lower ends of the planar strips 108.

A humidifier 300 that is a third alternative embodiment of the invention is illustrated in FIGS. 15–19. Except as identified below, the humidifier 300 is substantially the same as the humidifier 10 and like elements have been given like numerals. In the humidifier 300, the upper frame member 116 and the lower frame member 144 have therein a plurality of slots 304 extending generally parallel to the axis 128 and thus being elongated in a direction generally perpendicular to the planar strips 108. These slots 304 have generally parallel walls 308 extending from the outer surface 120 to the inner surface 124. A plurality of ribs 312 extend across and beneath the slots 304, and the adhesive 140 fills the slots 304. Each slot 304 is an opening in the frame member, and adjacent ribs 312 define therebetween a restricted portion of the opening. When the adhesive 140 enters the slots 304, it is soft and it surrounds the ribs 312. As the adhesive 140 hardens around the ribs 312, the adhesive mechanically interlocks with the ribs 312 and adheres to the ends of the planar strips 108. The adhesive thus becomes a rigid structure or material that is located on the opposite side of the above-mentioned restricted portion from the wick portions 104 and that is prevented from coming out of the above-mentioned opening by a wedging action in the restricted portion of the opening.

Various features of the invention are set forth in the following claims.

I claim:

1. A humidifier comprising a trough adapted to contain water, a wicking assembly having a lower end located in said trough and including a plurality of wick portions each having an end, and frame means for supporting said wick portions in generally parallel, side-by-side relation, said frame means including a first frame member extending generally perpendicular to said wick portions and adjacent said ends of said wick portions, and first means which is adhesively secured to said ends of said wick portions and which is non-adhesively mechanically interlocked with said frame member regardless of whether said first means adheres to said frame member, and means for causing air flow through said wicking assembly.

2. A humidifier as set forth in claim 1 and further comprising container means adapted to contain water, and means for supplying water from said container means to said trough.

3. A humidifier as set forth in claim 1 wherein said frame member has therethrough a slot elongated in a direction generally perpendicular to said wick portions and includes a plurality of ribs extending across said slot, and wherein said first means extends into said slot and mechanically interlocks with said ribs.

4. A humidifier as set forth in claim 1 and further comprising reservoir means for receiving water accidentally overflowing said trough.

5. A humidifier as set forth in claim 1 wherein each of said wick portions has an opposite end, and wherein said frame means also includes a second frame member extending generally parallel to said first frame member and adjacent said opposite ends of said wick portions, second means secured to said opposite ends of said wick portions and mechanically interlocked with said second frame member, and generally parallel third and fourth frame members extending generally parallel to said wick portions and extending generally perpendicular to and between said first and second frame members.

6. A humidifier as set forth in claim 5 wherein said second frame member is located in said trough and includes means for housing a biocide.

7. A humidifier as set forth in claim 5 wherein said second frame member has therethrough a slot elongated in a direction generally perpendicular to said wick portions, and wherein said adhesive means extends into said second slot and adheres to said opposite ends of said wick portions.

8. A humidifier as set forth in claim 1 and further comprising a cabinet housing said trough and said wicking assembly and having therein an air inlet, and wherein said frame means defines a conduit substantially sealingly communicating with said air inlet and housing said wick portions such that substantially all of the air entering said cabinet through said air inlet passes through said conduit and over said wick portions.

9. A humidifier as set forth in claim 8 and further comprising reservoir means for receiving water accidentally overflowing said trough.

10. A humidifier comprising a trough adapted to contain water, a wicking assembly having a lower end located in said trough and including a plurality of wick portions each having an end, and frame means for supporting said wick portions in generally parallel, side-by-side relation, said frame means including a first frame member extending generally perpendicular to said wick portions and adjacent said ends of said wick portions, said frame member having an outer surface, and an inner surface adjacent said ends of said wick portions, and said frame member having therethrough a slot which extends between said inner and outer surfaces, which is elongated in a direction generally perpendicular to said wick portions, and which includes a portion having a cross-sectional area decreasing in the direction from said outer surface to said inner surface, and first adhesive means secured to said ends of said wick portions and mechanically interlocked with said frame member, said adhesive means filling said portion of said slot, and means for causing air flow through said wicking assembly.

11. A humidifier comprising a trough adapted to contain water, a cabinet housing said trough and including a wall having therein an air inlet, a wicking assembly which is housed by said cabinet, and which has a lower end located in said trough, and which includes a plurality of wick portions, and frame means for supporting said wick portions, said frame means defining a conduit communicating with said air inlet, housing said wick portions, and having portions substantially sealingly engaging said wall in surrounding relation to said inlet such that substantially all of the air entering said cabinet through said air inlet passes through said conduit and over said wick portions, and means for drawing air into said cabinet through said air inlet and through said wicking assembly.

12. A humidifier as set forth in claim 11 and further comprising container means adapted to contain water, and means for supplying water from said container means to said trough.

13. A humidifier as set forth in claim 11 wherein said frame means includes means located in said trough for housing a biocide.

14. A humidifier as set forth in claim 11 and further comprising reservoir means for receiving water accidentally overflowing said trough.

15. A humidifier as set forth in claim 11 wherein said frame means includes frame members extending transversely to said wall and having edges substantially sealingly engaging said wall.

16. A humidifier comprising a trough adapted to contain water, a wicking assembly having a lower end located in said trough, means for causing air flow through said wicking assembly, and means defining a reservoir which is free of mechanical equipment, which is normally empty, and which receives water accidentally overflowing said trough.

17. A humidifier as set forth in claim 16 and further comprising container means adapted to contain water, and means for supplying water from said container means to said trough.

18. A humidifier as set forth in claim 16 wherein said trough has a bottom, and wherein said reservoir has a bottom located beneath said bottom of said trough.

19. A humidifier as set forth in claim 16 wherein said means for causing air flow includes a fan remote from said reservoir.

20. A humidifier comprising a trough adapted to contain water, a wicking assembly having a lower end located in said trough and including a plurality of wick portions each including a generally planar strip of wicking material having an end, and a pleated strip of wicking material secured to said planar strip, and frame means for supporting said wick portions in generally parallel, side-by-side relation, said frame means including a first frame member extending generally perpendicular to said planar strips and adjacent said ends of said planar strips and having therethrough a slot elongated in a direction generally perpendicular to said planar strips, and first adhesive means extending into said slot and adhering to said ends of said planar strips for securing said ends of said planar strips to said frame member, and means for causing air flow through said wicking assembly.

21. A humidifier comprising a trough adapted to contain water, a wicking assembly having a lower end located in said trough and including a wick portion, frame means for supporting said wick portion, said frame means including a first frame member having therein an opening with a restricted portion, and a material which is secured to said wick portion, which enters said opening in a soft condition, and which hardens and is prevented from coming out of said opening by wedging action in said restricted portion, and means for causing air flow through said wicking assembly.

22. A humidifier comprising a trough adapted to contain water, a wicking assembly having a lower end located in said trough and including a plurality of wick portions each having an end, and frame means for supporting said wick portions in generally parallel, side-by-side relation, said frame means including a first frame member extending generally perpendicular to said wick portions and adjacent said ends of said wick portions, said frame member having therethrough a slot elongated in a direction generally perpendicular to said wick portions, and first adhesive means which is secured to said ends of said wick portions and which extends into said slot, and means for causing air flow through said wicking assembly.

23. A humidifier as set forth in claim 22 wherein said frame member also includes a plurality of ribs extending across said slot, and wherein said adhesive means mechanically interlocks with said ribs.

24. A humidifier as set forth in claim 22 wherein each of said wick portions has an opposite end. and wherein said frame means also includes a second frame member extending generally parallel to said first frame member and adjacent said opposite ends of said wick portions, said second frame member having therethrough a second slot elongated in a direction generally perpendicular to said wick portions, second adhesive means secured to said opposite ends of said wick portions and extending into said second slot, and generally parallel third and fourth frame members extending generally parallel to said wick portions and extending generally perpendicular to and between said first and second frame members.

25. A humidifier comprising a trough adapted to contain water, a wicking assembly having a lower end located in said trough and including a wick portion, frame means for supporting said wick portion, said frame means including a frame member having therein an opening with a restricted portion, and rigid structure which is secured to said wick portion, which is located in said opening on the opposite side of said restricted portion from said wick portion, and which is prevented by said restricted portion from coming out of said opening, and means for causing air flow through said wicking assembly.

* * * * *